US006188858B1

(12) United States Patent
Swapceinski et al.

(10) Patent No.: US 6,188,858 B1
(45) Date of Patent: Feb. 13, 2001

(54) ROLLER DRIVING APPARATUS OF PRINTER

(75) Inventors: John P. Swapceinski, Bergen, NY (US); Jeong-hun Pang, Suwon (KR)

(73) Assignee: Samsung Electronics Co., Ltd., Kyungki-do (KR)

( * ) Notice: Under 35 U.S.C. 154(b), the term of this patent shall be extended for 0 days.

(21) Appl. No.: 09/425,198

(22) Filed: Oct. 22, 1999

(30) Foreign Application Priority Data

Oct. 22, 1998 (KR) ..... 98-44353

(51) Int. Cl.[7] ..... G03G 15/00
(52) U.S. Cl. ..... 399/167
(58) Field of Search ..... 399/162, 167

(56) References Cited

U.S. PATENT DOCUMENTS 4,046,473 * 9/1977 Trainer ..... 399/162
5,132,728 * 7/1992 Suzaki et al. ..... 399/167
5,937,241 * 8/1999 Kumar et al. ..... 399/167 X
6,011,942 * 1/2000 Taniguchi et al. ..... 399/167
6,032,008 * 2/2000 Kolodziej ..... 399/167

* cited by examiner

*Primary Examiner*—Fred L Braun
(74) *Attorney, Agent, or Firm*—Robert E. Bushnell, Esq.

(57) ABSTRACT

A roller driving apparatus having a roller contacting and rotating a photo-receptor web in a printer is provided. The apparatus includes a support shaft coaxially fixed to the roller and having a coupling groove formed in an outer circumferential surface thereof in a radial direction, a rotation member inserted around the support shaft, a coupling member coupled to the rotation member to protrude and retreat with respect to an inner circumferential surface of the rotation member, and inserted in the groove of the support shaft when protruding from the inner circumferential surface of the rotation member; a spring elastically biasing the coupling member in a direction to protrude from the inner circumferential surface of the rotation member, a motor, and a power transfer unit transferring the power from the motor to the rotation member to rotate the rotation member.

20 Claims, 6 Drawing Sheets

ROLLER DRIVING APPARATUS OF PRINTER

CLAIM OF PRIORITY

This application makes reference to, incorporates the same herein, and claims all benefits accruing under 35 U.S.C. § 119 from an application entitled ROLLER DRIVING APPARATUS OF PRINTER earlier filed in the Korean Industrial Property Office on the 22$^{nd}$ day of Oct. 1998 and there duly assigned Serial No. 44353/1998.

BACKGROUND OF THE INVENTION

1. Field of the Invention

The present invention relates to a driving mechanism for rotating a roller closely contacting a photo-receptor web in a printer, and, more particularly, to a roller driving mechanism and process for transferring rotational power between the roller and a motor in an image formation apparatus.

2. Description of the Related Art

Various types of structures connecting a gear to a roller to feed a photo-receptor web are used in printers. A common design for image formation equipment such as a printer or a photocopier for printing images and characters onto printable paper uses a photo-receptor web supported by and wound around a pair of rollers, a laser scanning unit that forms electrostatic latent images or characters on the surface of the photo-receptor web, and a developing unit that forms toner images corresponding to the electrostatic latent images on the photo-receptor web. The toner images formed on the photo-receptor web are transferred to printable paper stock via a transfer roller while the photo-receptor web passes between set of rollers. Typically, gears transfer rotational power from a motor to the rollers. We have found that conventional structures for connecting the gear to the roller are not suitable to transfer the rotating power to the roller precisely. If a load is applied to the roller, the gear can not rotate the roller precisely because the load applied to the roller causes the structure between the roller and the gear to prevent the gear from transferring the rotating power to the roller precisely.

We have noticed that it is not easy during assembly or during subsequent operation of the roller driving apparatus to precisely perform the installation and the engagement of thread portions which are formed on first and second clutch members and which face each other. Moreover, it takes too much time for assembly, maintenance and repair of the roller driving apparatus since the entire structures are complicated. Furthermore, the first and second clutch members and neither engage each other precisely nor rotate integrally, thereby the rotating force of the motor is not accurately transferred to the roller because one clutch member retreats from the other clutch member when a load is applied to the roller. The rotating power transferred from motor to one of the clutch members and the load transferred from supporting shaft to the other of the clutch member causes the two clutch members to retreat from each other against the elastic force of the spring. Therefore, one of the clutch members slips from the other clutch member, and the rotational force of the motor is not accurately transferred to the roller. Therefore, constant-speed rotation of the roller and constant speed circulation of the photo-receptor are not achieved. The level of quality in the printing operation is lowered. In our opinion, this design for the roller driving mechanism for rotating the rollers that contact and circulate the photo-receptor web is neither suitable to transfer the rotating force from the motor to the rollers nor adequate to assemble and maintain the clutch members to contact each other precisely.

SUMMARY OF THE INVENTION

It is an object of the present invention to provide an improved roller deriving apparatus for precisely transferring a rotating force from motor to a roller.

It is another object to provide a roller deriving apparatus able to accurately rotate the roller.

It is an yet another object to provide an apparatus for preventing the gear transmitting the rotating force to the roller from slipping from the roller.

It is still another object to provide an apparatus for allowing the gear to precisely engage the roller.

It is still yet object to provide an apparatus able to form an electrostatic image and a toner image on a photo-receptor web.

It is further object to provide an apparatus able to fix a toner image of the photo-receptor web on a sheet of paper.

It is also an object to provide an apparatus for obtaining constant speed rotation of the roller.

It is also an object to provide an apparatus for preventing relative rotating movement between a roller and a gear during transferring of the rotating power.

These and other objects may be achieved by providing a roller driving apparatus in a printer including a support shaft coaxially fixed to the roller, a coupling groove formed on an outer circumferential surface in a radial direction, a rotation member receiving a rotating force from a motor through a connecting gear and driving gear and having a shaft coupling hole accommodating the support shaft, a coupling member inserted into a receiving hole formed on the rotation member to be capable of moving in a direction of the axis of the center of the receiving hole, and a spring elastically and radially biasing the coupling member in a direction to protrude from the inner circumferential surface of the rotation member. The coupling member protrudes and retreats with respect to an inner circumferential surface of the rotation member and is inserted into the groove of the support shaft when protruding from the inner circumferential surface of the rotation member without moving relatively and slipping coaxially between the rotation member and roller.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
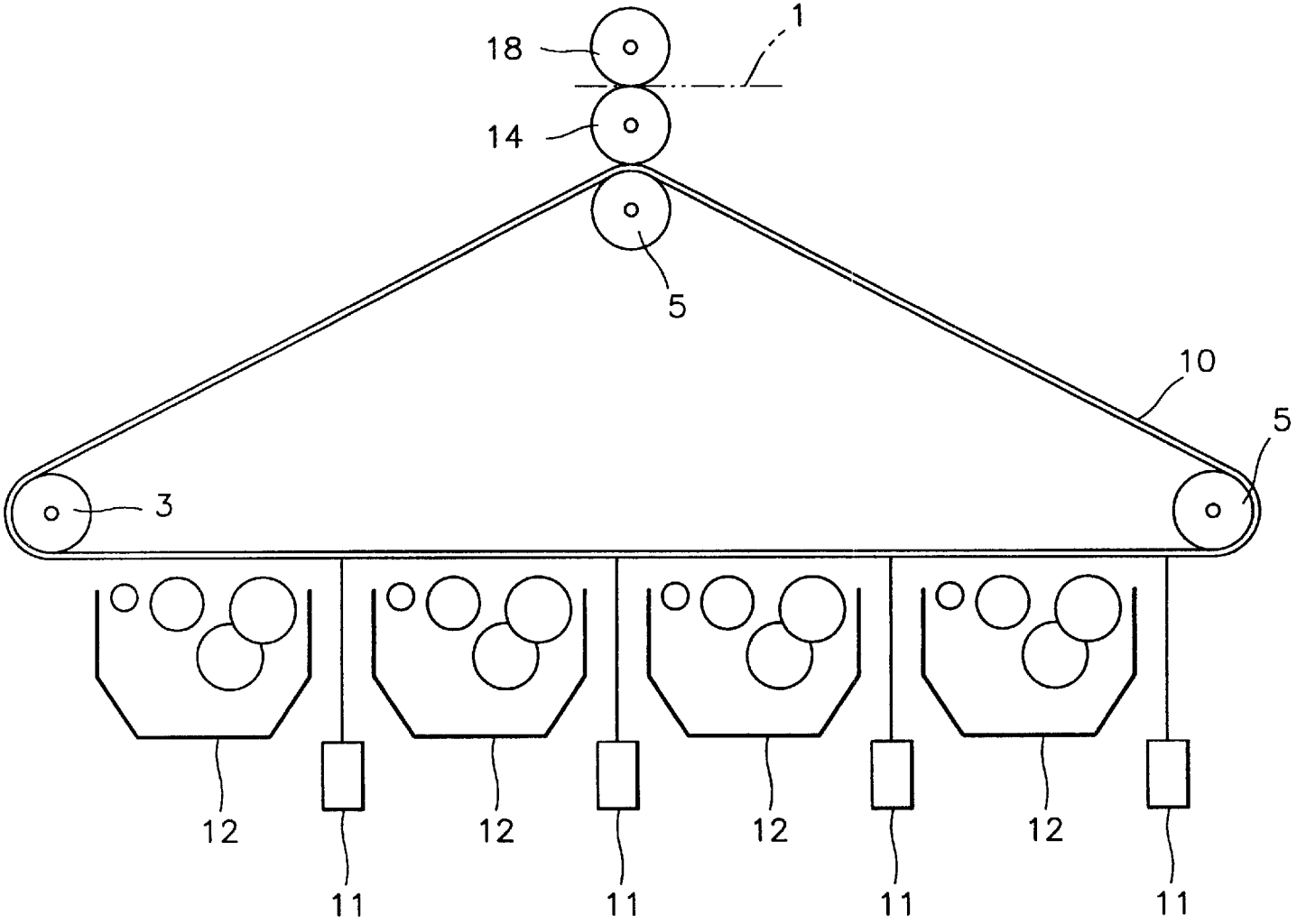
FIG. 1 is a view schematically showing the structure of a printer suitable for the practice of the present invention.

As shown in FIG. 1, an image formation apparatus such as a printer or a copier for performing printing on a predetermined printable paper may be constructed with a photo-receptor web 10 supported by and wound around rollers 3 and 5, a laser scanning unit 11 for forming an electrostatic latent image on the photo-receptor web 10, and a developing unit 12 for forming a toner image corresponding to the electrostatic latent image on the photo-receptor web 10. The toner image formed on the photo-receptor web 10 is transferred to a printable paper 1 via a transfer roller 14 while the photo-receptor web 10 passes between rollers 5 and 14. The toner image transferred to the printable paper is fixed by a fixing roller 18.

Figure 2:
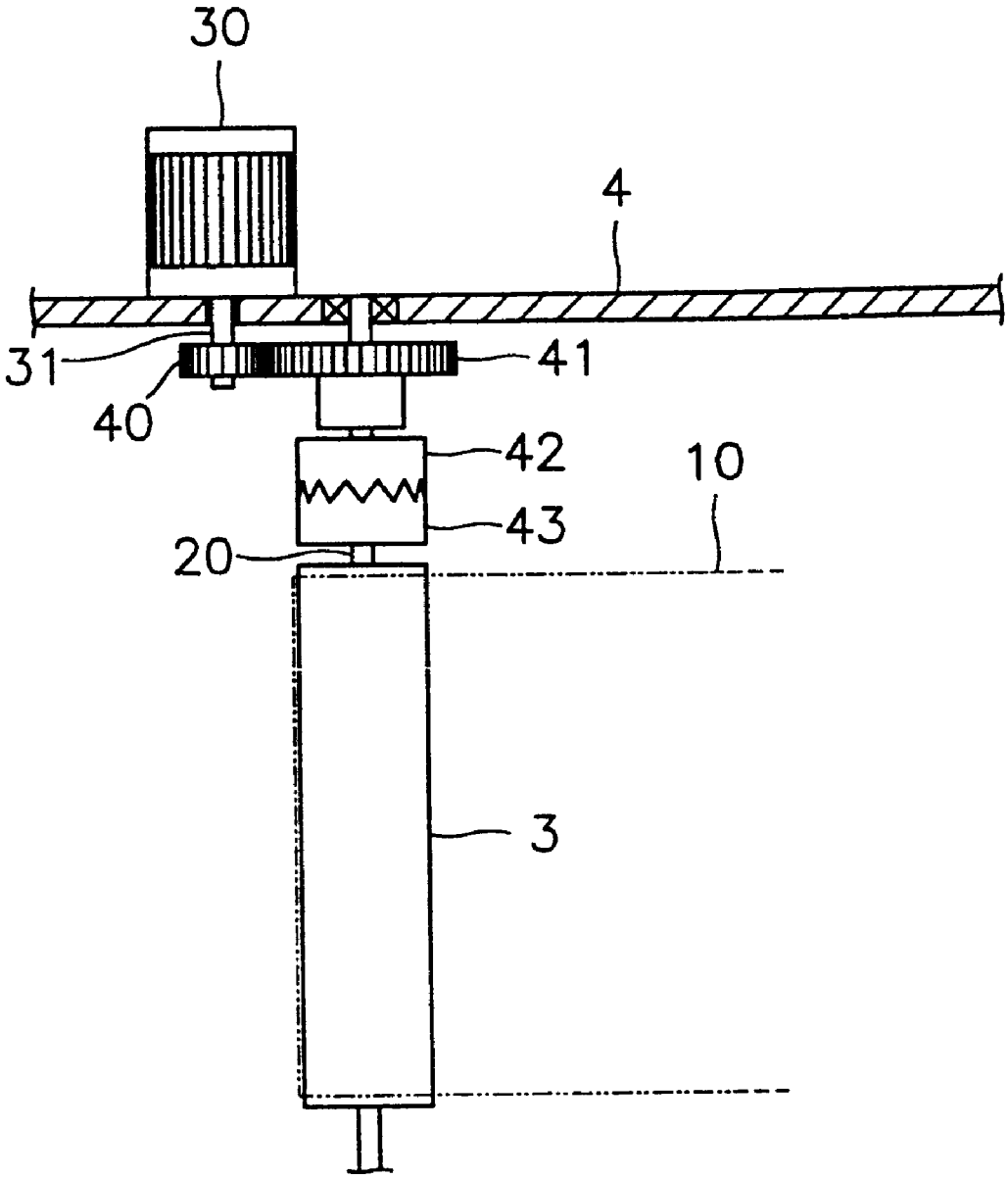
FIG. 2 is a view schematically showing the structure of one design for a driving mechanism for driving the roller of the printer shown in FIG. 1.
Figure 3:
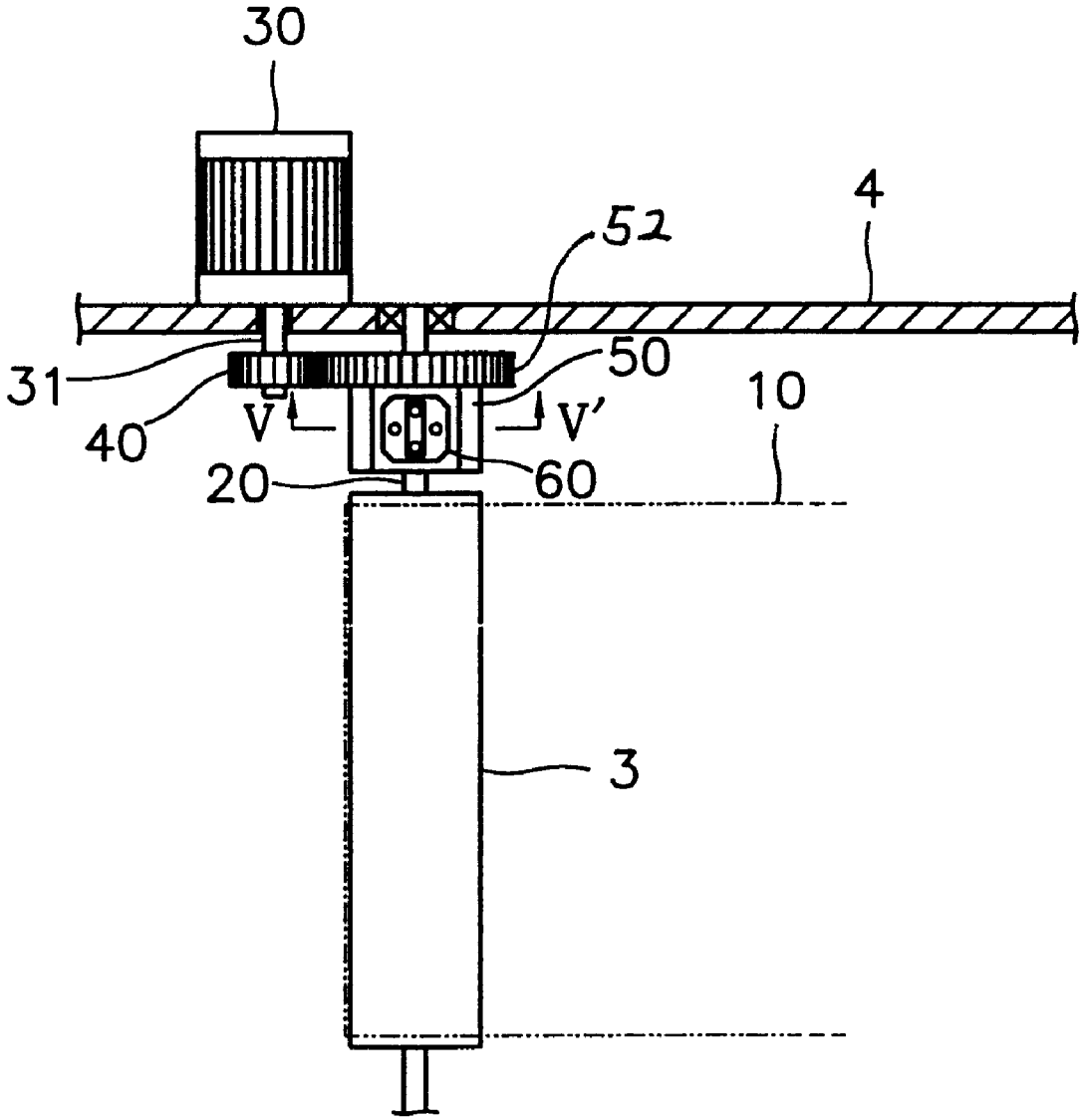
FIG. 3 is a view schematically showing the structure of a second roller driving mechanism for driving a printer according to the principles of the present invention.
Figure 4:
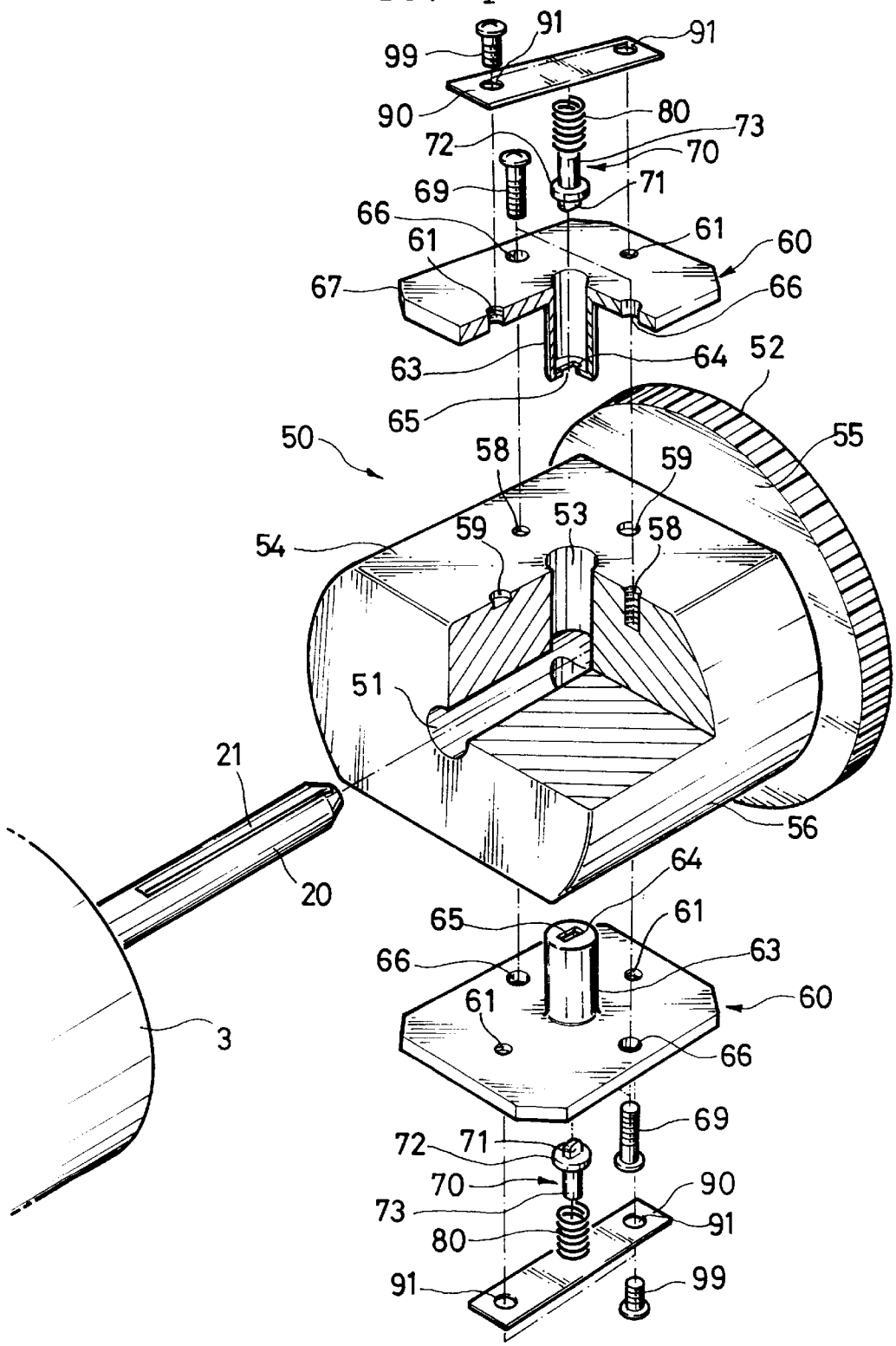
FIG. 4 is an exploded perspective view of the roller driving apparatus shown in FIG. 3.

FIG. 2 shows a roller driving apparatus for rotating rollers 3 and 5 which contact and circulate photo-receptor web 10. A motor 30 is installed in a frame 4 of the printer, and a motor shaft 31 connected to motor 30 transfers the rotation power from motor 30 to roller 3 through driving gear 40 fixedly connected to motor shaft 31, connecting gear 41 engaging driving gear 40, and a pair of first and second clutch members. First clutch member 42 is connected to connecting gear 41 while second clutch member 43 is fixedly connected to support shaft 20. A spring (not shown) is located in first clutch member 42 so as to allow the first clutch member to move in the direction of the axis passing the center of connecting gear 41, first and second clutch members, and supporting shaft 20. Thread portions formed on first and second clutch members 42 and 43 face each other and engage each other. First clutch member 42 coupled to a connecting shaft of connecting gear 41 is capable of rotating together with the driven gear 41 and of sliding in the axial direction of the driven gear 41.

In the normal state as shown in FIG. 2, thread portion of the first clutch member 42 is suitably engages the thread portion of second clutch member 43 because first clutch member 42 is elastically biased by the spring (not shown) toward the second clutch member 43. Thus, when driving gear 40 rotates connecting gear 41, first and second clutch members 42 and 43, support shaft 20, and the roller 3 rotate together in the same direction. The photo-receptor web 10 contacts the outer surface of the roller 3 and 5 and circulates around rollers 3 and 5 by the frictional force generated between roller 3 and the photo-receptor web 10.

However, it is not easy during assembling and operating of the roller driving apparatus to precisely perform the installation and the engagement of thread portions which are formed on first and second clutch members 42 and 43 respectively and which face each other. Furthermore, it take too much time for assembly, maintenance and repair of the roller driving apparatus since the entire structures are complicated. Moreover, the first and second clutch members 42 and 43 neither engage each other precisely nor rotate integrally, thereby the rotating force of the motor 30 is not accurately transferred to the roller 3 because first clutch member 42 retreats from the second clutch member 43 when a load is applied to the roller 3. The rotating power transferred from motor 30 to first clutch member 42 and the load transferred from supporting shaft 20 to second clutch member 43 cause first clutch member 42 to retreat from second clutch member 43 against the elastic force of the spring. First clutch member 42 slips from the second clutch member 43. The rotating force of the motor 30 is not accurately transferred to the roller 3. Although, constant-speed rotation of the roller and constant-speed circulation of the photo-receptor are achieved. The level of quality in the printing operation may be lowered.

In our opinion, the apparatus techniques represented in FIG. 2 are neither suitable to adequately transfer the rotation force from the motor to the roller nor adequate to assemble and maintain the clutch members in precise contact with each other.

Referring now to FIGS. 1 and 3 through 5 collectively, a roller driving apparatus of the present invention includes a support shaft 20, a motor 30, a rotation member 50 having a gear portion 52, a pair of coupling members 70, a pair of springs 80, and power transfer members such as a motor shaft 31 and a driving gear 40. Support shaft 20 is coaxially fixed to roller 3 to support the roller 3 contacting the photo-receptor web 10. A pair of coupling grooves 21 as key-seats are formed on support shaft 20 by indenting the outer circumferential surface of the support shaft 20 in a radial direction.

Rotation member 50 includes a circular plate 55 having gear portion 52 and a rotating rod 56. Rotation member 50 is rotatably fixed to a frame 4 to which motor 30 is attached. Gear portion 52 formed on circular plate 55 of rotation member 50 contacts driving gear 40 to receive the rotating power from motor 30. A pair of flat planes 54 as a normal plane are symmetrically formed on each side of rotating rod 56 of rotation member 50 by cutting a peripheral portion of the rotating rod in the direction perpendicular to a radial plane passing a central axis of rotating rod 56. A shaft coupling hole 51 into which supporting shaft 20 is inserted is formed on rotating rod 56 in rotation member 50 in the axial direction and has the same central axis as rotating rod 56 of rotation member 50 and supporting shaft 20. A pair of receiving holes 53 are formed on rotating rod 56 in rotation member 50 in a radial direction so as to be perpendicular to the shaft coupling hole 51. Receiving holes 53 penetrate shaft coupling hole 51.

A receiving member 60 includes connecting plate 67, hollow receptacle 63 extended from connecting plate 67, cap plate 64 formed on the top portion of hollow receptacle 63, and a coupling hole formed on cap plate 64. Hollow receptacle 63 of receiving member 60 is inserted into each of receiving hole 53 while connecting plate 67 of receiving member 60 is placed on flat plane 54 of rotating rod 56 in rotation member 50. Receiving member 60 is fixed on rotation member 50 by screws 69 coupling connecting plate 67 to flat plane 57 in rotating rod 56 through holes 66 and 58.

Figure 5:
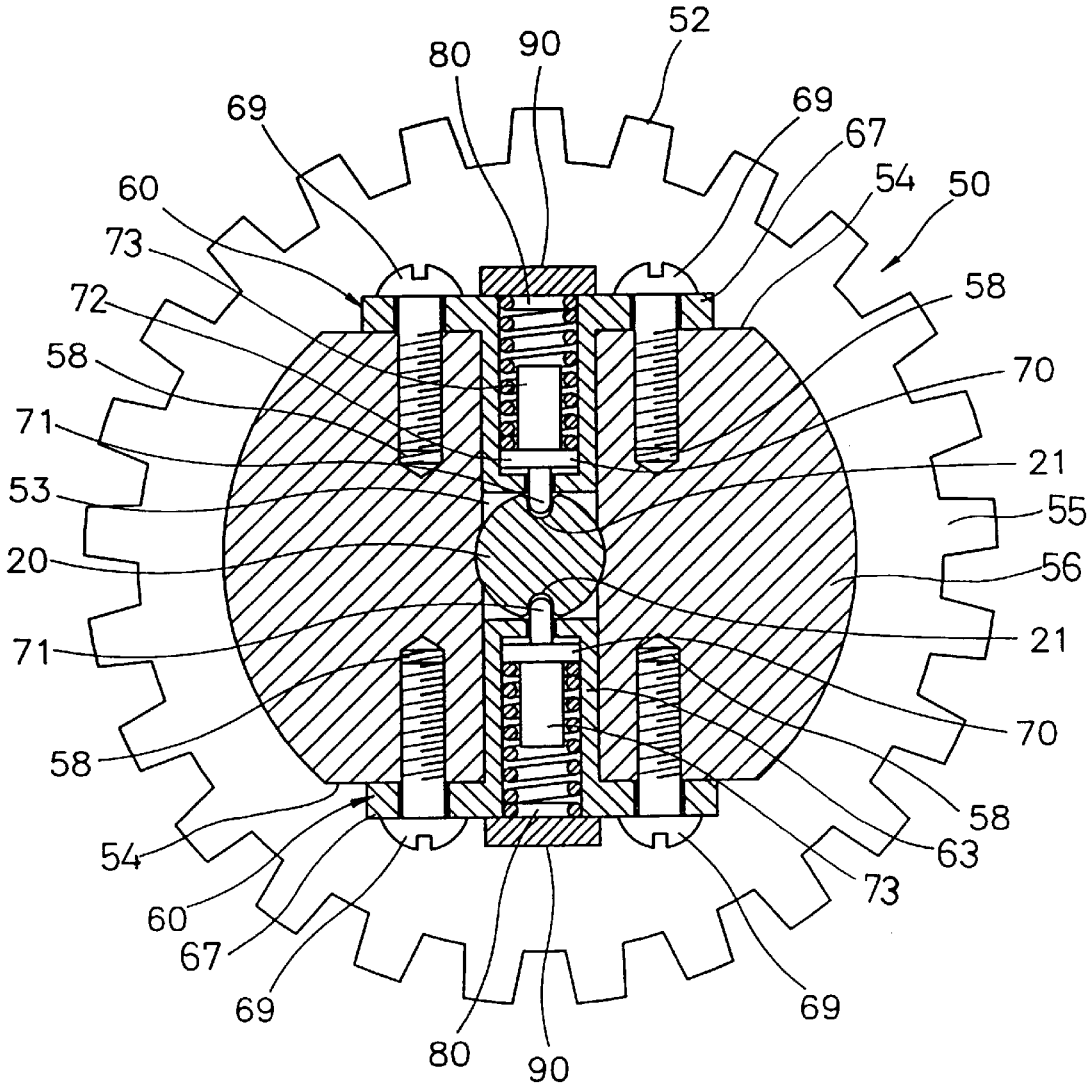
FIG. 5 is a sectional view taken along sectional line V–V' of the roller driving apparatus shown in FIG. 3.

A pair of coupling members 70 having coupling protrusion 71 as a key, stopper 72, and extending bar 73 is inserted into hollow receptacle 63 in receiving member 60 after receiving member 60 is fixed on rotation member 50. The coupling member 70 is freely and linearly moving in the radial direction of rotation rod 56 of rotation member in hollow receptacle 63 of receiving member 60. Coupling member 70 protrudes and retreats with respect to the inner circumferential surface of receiving hole 53 of the rotation member 50. As shown in FIG. 5, the coupling member 70 moves toward the center of rotating rod 56 of the rotation member 50. Coupling protrusion 71 provided at one end of the coupling member 70 protrudes through coupling hole from the inner circumferential surface of the rotation member 50 toward shaft coupling hole 51 so as to insert coupling protrusion 71 into the coupling groove 21 of the support shaft 20 while the supporting shaft 20 is inserted into shaft coupling hole 51. Each coupling member 70 inserted into the receiving hole 53 rotates together with rotation member 50 and does not rotate with respect to rotation member 50. Coupling member 70 and rotation member 50 rotate integrally without the relative rotation of the coupling member 70 with respect to the rotation member 50.

A spring 80 is inserted between hollow receptacle 63 of receiving member 60 and extended rod 73 of coupling member 70 after coupling member 70 is inserted into hollow receptacle 63. A cover 90 is attached to connecting plate 67 to cover one opening end of hollow receptacle 63 by screws 99 through holes 91 and 61 while hollow receptacle 63 accommodates coupling member and spring 80. Spring 80 is prevented from being separated from receiving member 60 by fixing cover 90 to receiving member 60. One end of spring 80 contacts cover 90, and the other end of spring 80 contacts stopper 72 of coupling member 70. Spring 80 elastically biases the coupling member 70 toward the center of rotating rod 56 of rotation member 50. Coupling protrusion 71 protrudes through coupling hole 65 and is inserted into coupling groove 21 of supporting shaft 20. If an external force is applied to coupling member 70 in a radial direction from the center of the rotation member 50 toward the outside, the coupling member 70 moves by a predetermined distance to retreat from the center of rotating rod 56 of rotation member 50 while stopper 72 of coupling member 70 compresses spring 80.

The rotating power is transferred from motor 30 to rotation member 50 through driving gear 40 and gear portion 52. Driving gear 40 is fixed to output shaft 31 of the motor 30. The gear portion 52 is integrally formed on the peripheral surface of circular plate 55 of rotation member 50 and engages driving gear 40. Rotation member 50 transfers the rotating power to supporting shaft 20 of roller 3 through coupling member 70 and coupling groove 21 while spring pushes the stopper 72 toward cap plate in order to insert coupling protrusion 71 into coupling groove 21 which is deep enough to accommodate coupling protrusion 71.

After coupling member 70 is inserted into receiving member 60 which is attached to flat plane 54 and covered by cover 90, supporting shaft 20 is inserted into shaft coupling hole 51 of rotating rod in rotation member 50 so as to insert coupling protrusion 71 into coupling groove and couple supporting shaft 20 to rotation member 50. When coupling protrusion 71 of coupling member 70 is befittingly inserted into coupling groove 21 of supported shaft 20, coupling member 70 and support shaft 20 rotate integrally without the relative rotation of the coupling member 70 with respect to the rotation member 50.

If coupling groove 21 and coupling protrusion 71 do not correspond to each other when supporting shaft 20 is inserted in shaft coupling hole 51, coupling protrusion 71 contacts the circumferential surface of supporting shaft 20 other than coupling groove 21 by a restoring force of spring 80 compressed by stopper 72. Coupling member 70 compresses spring 80 and retreats with respect to the inner circumferential surface of rotation member 50 so that supporting shaft 20 is inserted in shaft coupling hole 51. Coupling protrusion 71 can be inserted into coupling groove 21 by rotating any one of supporting shaft 20 or rotation member 50 by a predetermined angle. During rotating support shaft 20 or rotation member 50, coupling groove 21 is located at a position corresponding to coupling protrusion 71, and coupling member 70 moves toward the center of rotating rod of rotation member 50 by the restoring force of spring 80, and coupling protrusion 71 of coupling member 70 is befittingly inserted in the corresponding coupling groove 21.

In the roller driving apparatus of the above preferred embodiment, roller 3 and motor 30 are dynamically connected when support shaft 20 is inserted in shaft coupling hole 51 of rotating rod 56 in rotation member 50 or when support shaft 20 rotates after supporting shaft 20 is inserted into shaft coupling hole 51 of rotating rod 56 in rotation member 50. Roller 3 is dynamically connected to rotation member 50, and the engagement between coupling protrusion 71 and coupling groove 21 can be securely maintained without slipping between roller 3 and rotation member 50.

Although a pair of coupling grooves 21 and coupling members 70 are described in the present preferred embodiment, it is possible that three sets of coupling grooves 21 and coupling members 70 may be provided with an angular intervals of 120° between coupling grooves or coupling members. For some cases, only one coupling groove 21 and one coupling member 70 is sufficient to achieve the objective of the present invention.

Figure 6:
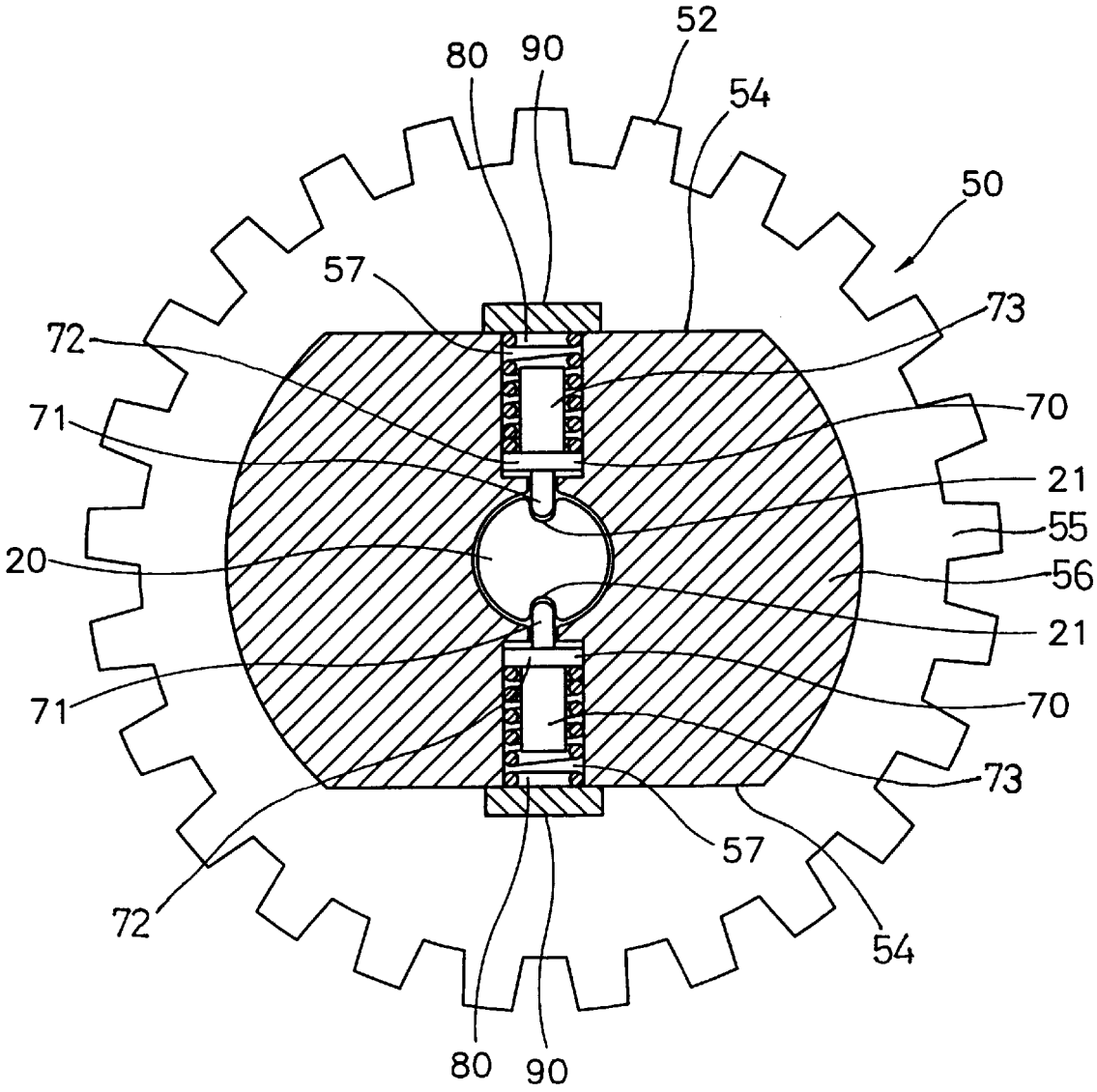
FIG. 6 is a sectional view of major portions of a roller driving apparatus according to another design constructed according to the principles of the present invention.

Instead of providing receiving member 60 in FIG. 5, a receiving portion 57 is formed on rotation member 50 as shown in FIG. 6. Coupling member 70 and spring 80 are inserted into receiving portion 57. Cover 90 is attached to flat plane 54 of rotation member 50 and covers coupling member 70 and spring 80 for preventing coupling member 70 and spring 80 from escaping.

The same reference numerals shown in FIGS. 5 and 6 have the same functions. Although the preferred embodiment shown in FIG. 6 has the same effect as that described in FIGS. 3 through 5, the work for dynamically connecting roller and motor becomes more easy, and the structure of the roller driving apparatus shown in FIG.6 is more simplified compared to the embodiment shown in FIGS. 3 through 5.

It is noted that the present invention is not limited to the preferred embodiment described above, and it is apparent that variations and modifications by those skilled in the art can be effected within the spirit and scope of the present invention defined in the appended claims.

As described above, in the roller driving apparatus of a printer according to the present invention, the structure of the roller driving apparatus becomes simplified, and the work for efficiently assembling and dynamically connecting roller 3 to motor 30 is more convenient than the conventional roller driving apparatus. Moreover, the engagement between coupling protrusion 71 and coupling groove 21 can be securely maintained without slipping between roller and rotation member even when an overload is applied to roller 3 because coupling member 70 is coupled to support shaft 20 in a radial direction of support shaft 20. Furthermore, rotation member 50 and support shaft 20 can rotate integrally so that an accurate constant-speed rotation of roller 3 can perform.

What is claimed is:

1. A roller driving apparatus in a printer, comprising:

a supporting shaft coaxially fixed to a roller, having a coupling groove formed on said supporting shaft;

a rotation member connected to a motor rotating by said motor, having a coupling hole accommodating said supporting shaft;

a coupling member elastically connected to said rotation member, moving radially and coupling said coupling member to said supporting shaft by receiving said coupling member into said groove; and a spring elastically connecting said coupling member to said rotation member.

2. The apparatus of claim 1, further comprised of said coupling groove formed on an outer circumferential surface of said supporting shaft.

3. The apparatus of claim 1, said spring disposed between said coupling member and said rotation member.

4. The apparatus of claim 1, said spring giving said coupling member an elastically radial movement toward said groove.

5. The apparatus of claim 1, further comprised of a coupling protrusion formed on one end of said coupling member and inserted into said groove.

6. The apparatus of claim 5, further comprised of a stopper formed on said coupling member, limiting said coupling protrusion from protruding after said coupling protrusion is inserted into said groove.

7. The apparatus of claim 1, further comprised of a stopper formed said coupling member, limiting said coupling member from protruding after said coupling member is inserted into said groove.

8. The apparatus of claim 1, further comprised of a receiving member fixed to said rotation member, having a receptacle accommodating said coupling member.

9. The apparatus of claim 8, further comprised of a cover attached to said rotating member, covering said spring and said coupling member while said spring and said coupling member are inserted into said receiving member.

10. The apparatus of claim 1, further comprised of a receiving hole formed on said rotation member, accommodating said coupling member, and allowing said coupling member to radially move toward said coupling groove.

11. The apparatus of claim 10, further comprised of:

a spring inserted into said receiving hole; and a cover fixed to said rotation member, allowing said spring to bias said coupling member.

12. A roller driving apparatus in a printer, comprising:

a roller;

a rotation member connected to a motor, having a coupling hole;

a supporting shaft coaxially extended from said roller, having a coupling groove formed on said supporting shaft, inserted into said coupling hole;

a coupling member elastically connected to said rotation member, moving radially, inserted into said coupling groove, coupling said coupling, member to said supporting shaft so as to transfer rotation power from said rotation member to said supporting shaft; and a spring elastically connecting said coupling member to said rotation member, disposed between said coupling member and said rotation member.

13. The apparatus of claim 12, further comprised of said roller feeding a photo-receptor web.

14. The apparatus of claim 12, further comprised of said rotation member formed in a body, including a gear portion connected to said motor and a rotating rod accommodating said supporting shaft.

15. The apparatus of claim 12, further comprised of a receiving hole formed on said rotating member, receiving said coupling member, having an axis forming an angle with a second axis passing a center of said coupling hole.

16. The apparatus of claim 12, further comprised of a cover fixed to said rotation member, allowing said spring to bias said coupling member.

17. The apparatus of claim 12, further comprised of a receiving member fixed to said rotation member, having a receptacle accommodating said coupling member.

18. The apparatus of claim 12, further comprised of said coupling groove formed on an outer circumferential surface of said supporting shaft in an axial direction of said supporting shaft.

19. A roller driving apparatus in a printer, comprising:

a roller;

a shaft coaxially fixed to said roller, having a groove formed on said shaft;

a rotation member connected to a motor, having a coupling hole accommodating said shaft;

a coupling member disposed within said rotation member to couple said rotation member to said shaft by inserting said coupling member into said groove; and an elastic member disposed between said coupling member and said rotation member to bias said coupling member and elastically connect said coupling member to said rotation member.

20. The apparatus of claim 19, further comprising a stopper disposed on said rotation member to support said elastic member and said coupling member.

* * * * *